US010954587B2

(12) United States Patent
Mueller et al.

(10) Patent No.: US 10,954,587 B2
(45) **Date of Patent: *Mar. 23, 2021**

(54) UNCOATED BIODEGRADABLE CORROSION RESISTANT BONE IMPLANTS

(71) Applicant: BIOTRONIK AG, Buelach (CH)

(72) Inventors: Heinz Mueller, Diedrichshagen (DE); Peter Uggowitzer, Ottenbach (CH); Joerg Loeffler, Greifensee (CH)

(73) Assignee: BIOTRONIK AG, Buelach (CH)

( * ) Notice: Subject to any disclaimer, the term of this patent is extended or adjusted under 35 U.S.C. 154(b) by 158 days.

This patent is subject to a terminal disclaimer.

(21) Appl. No.: 15/933,688

(22) Filed: Mar. 23, 2018

(65) Prior Publication Data

US 2018/0237895 A1 Aug. 23, 2018

Related U.S. Application Data

(63) Continuation of application No. 14/396,012, filed as application No. PCT/EP2013/063253 on Jun. 25, 2013, now Pat. No. 10,344,365.

(60) Provisional application No. 61/664,224, filed on Jun. 26, 2012, provisional application No. 61/664,274, filed on Jun. 26, 2012, provisional application No. 61/664,229, filed on Jun. 26, 2012.

(30) Foreign Application Priority Data

Feb. 1, 2013 (DE) ..... 10 2013 201 696

(51) Int. Cl.
*C22F 1/06* (2006.01)
*C22C 23/04* (2006.01)

(52) U.S. Cl.
CPC ..... *C22F 1/06* (2013.01); *C22C 23/04* (2013.01)

(58) Field of Classification Search
CPC ..... C22C 23/04; C22F 1/06
USPC ..... 148/538
See application file for complete search history.

(56) References Cited

U.S. PATENT DOCUMENTS 5,698,158 A * 12/1997 Lam ..... B01D 3/10 266/149
10,344,365 B2 * 7/2019 Mueller ..... C22F 1/06
2007/0169859 A1 * 7/2007 Kawamura ..... C22C 23/04 148/667

FOREIGN PATENT DOCUMENTS

| | | | |
|---|---|---|---|
| CN | 1792383 | A * | 6/2006 |
| CN | 101948957 | A * | 1/2011 |
| JP | 2010529288 | A | 8/2010 |
| JP | 2011502565 | A | 1/2011 |
| WO | 2007058276 | A1 | 5/2007 |
| WO | 2011051424 | A1 | 5/2011 |

OTHER PUBLICATIONS

NPL: English translation of CN-1792383-A, Jun. 2006 (Year: 2006).*
NPL: translation of CN101948957A, Jan. 2011 (Year: 2011).*
NPL-2: Zhang et al Enhanced mechanical properties in fine-grained Mg-1.0Zn-0.5Ca alloys prepared by extrusion at different temperatures, Scripta Materilaia, 63 (2010) pp. 1024-1027 (Year: 2010).*
K. Oh-Ishi et al., "Age-hardening response of Mg-0.3at.%Ca alloys with different Zn contents", Materials Science and Engineering A, vol. 526, pp. 177-184, 2009.
Yuji Kawamura, Japanese Office Action for corresponding Japanese Application No. 2015-519055, dated Apr. 11, 2018.

* cited by examiner

*Primary Examiner* — Jie Yang
(74) *Attorney, Agent, or Firm* — Greer, Burns & Crain, Ltd.; Steven P. Fallon

(57) ABSTRACT

A preferred embodiment is an uncoated, biodegradable corrosion resistant bone implant. The implant includes a body being uncoated and lacking any protective polymer, metallic or ceramic coating, the body being shaped to fix to a bone and/or bone fragment. The body is formed of a magnesium alloy. The magnesium alloy includes from high-purity vacuum distilled magnesium containing impurities, which promote electrochemical potential differences and/or the formation of precipitations and/or intermetallic phases. The impurities are such that the body has a strength of >275 MPa, and a ratio yield point of <0.8, wherein the difference between strength and yield point is >50 MPa.

17 Claims, No Drawings

UNCOATED BIODEGRADABLE CORROSION RESISTANT BONE IMPLANTS

PRIORITY CLAIM

This application is continuation of and claims priority under 35 U.S.C. § 120 from U.S. application Ser. No. 14/396,012, now U.S. Pat. No. 10,344,365, which was filed on Oct. 21, 2014, which was a U.S. National Phase under 35 U.S.C. § 371 of International Application No. PCT/EP2013/063253, filed Jun. 25, 2013, which claims priority to U.S. Provisional Application No. 61/664,224, filed Jun. 26, 2012; to U.S. Provisional Application No. 61/664,229, filed Jun. 26, 2012; to U.S. Provisional Application No. 61/664,274, filed Jun. 26, 2012; and to German application DE 10 2013 201 696.4, filed Feb. 1, 2013.

FIELD OF THE INVENTION

The invention concerns bone implants for the treatment of injuries or disease. Example bone implants include bone screws, plates, wires and pins.

BACKGROUND

Bone implants include orthopedic implants, dental implants, neural implants and implants generally to fix bones and/or bone fragments. An example is bone screw or wire for craniofacial fixations. Common prior material for bone implants include permanent (non-degradable) materials, e.g., titanium, CoCr alloys and titanium alloys. There is an interest in providing biodegradable bone implants, but known biodegradable implants can be mechanically inferior to the permanent implants.

Biologically degradable bone implants must provide load-bearing function during a physiologically required support time. Magnesium materials have been proposed as implant materials, particularly for vascular implants such as stents. However, the known magnesium materials however fall far short of the strength properties provided by permanent bone implants, such as the aforementioned titanium, CoCr alloys and titanium alloys. The strength $R_m$ for permanent bone implants is approximately 500 MPa to >1,000 MPa, whereas by contrast that of the conventional magnesium materials is typically <275 MPa and in most cases <250 MPa.

Many magnesium materials, such as the alloys in the AZ group, also demonstrate a considerably pronounced mechanical asymmetry, which manifests itself in contrast to the mechanical properties, in particular the proof stress $R_p$ under tensile or compressive load. Asymmetries of this type are produced for example during forming processes, such as extrusion, rolling, or drawing, for production of suitable semifinished products. If the difference between the proof stress $R_p$ under tensile load and the proof stress $R_p$ under compressive load is too great, this may lead, in the case of a component that will be subsequently deformed multiaxially, and can result in inhomogeneous deformation with the result of cracking and fracture.

Generally, due to the low number of crystallographic slip systems, magnesium alloys may also form textures during forming processes, such as extrusion, rolling or drawing, for the production of suitable semifinished products as a result of the orientation of the grains during the forming process. More specifically, the semifinished product has different properties in different spatial directions. For example, after the forming process, there is high deformability or elongation at failure in one spatial direction and reduced deformability or elongation at failure in another spatial direction. The formation of such textures is likewise to be avoided, since high plastic deformation increases the risk of implant failure. One method for largely avoiding such textures during forming is the setting of the finest possible grain before the forming process. At room temperature, magnesium materials have only a low deformation capacity characterized by slip in the base plane due to their hexagonal lattice structure. If the material additionally has a coarse microstructure, i.e., a coarse grain, what is known as twin formation will be forced in the event of further deformation, wherein shear strain takes place, which transfers a crystal region into a position axially symmetrical with respect to the starting position.

The twin grain boundaries thus produced constitute weak points in the material, at which, specifically in the event of plastic deformation, crack initiation starts and ultimately leads to destruction of the component.

If implant materials have a sufficiently fine grain, the risk of such an implant failure is then highly reduced. Implant materials should therefore have the finest possible grain so as to avoid an undesired shear strain of this type.

All available commercial magnesium materials for implants are subject to severe corrosive attack in physiological media. The prior art attempts to confine the tendency for corrosion by providing the implants with an anti-corrosion coating, for example formed from polymeric substances (EP 2 085 100 A2, EP 2 384 725 A1), an aqueous or alcoholic conversion solution (DE 10 2006 060 501 A1), or an oxide (DE 10 2010 027 532 A1, EP 0 295 397 A1).

The use of polymeric passivation layers is controversial, since practically all corresponding polymers sometimes also produce high levels of inflammation in the tissue. On the other hand, structures without protective measures of this type do not achieve the necessary support times. The corrosion at thin-walled traumatological implants often accompanies an excessively quick loss of strength, which is additionally encumbered by the formation of an excessively large amount of hydrogen per unit of time. This results in undesirable gas enclosures in the bones and tissue.

In the case of traumatological implants having relatively large cross sections, there is a need to selectively control the hydrogen problem and the corrosion rate of the implant over its structure.

Specifically, in the case of biologically degradable implants, there is a desire for maximum body-compatibility of the elements, since, during degradation, all contained chemical elements are received by the body. Here, highly toxic elements, such as Be, Cd, Pb, Cr and the like, should be avoided.

Degradable magnesium alloys are particularly suitable for producing implants that have been used in a wide range of embodiments in modern medical engineering. For example, implants are used for orthopedic purposes, for example as pins, plates or screws.

Conventional implants with magnesium materials include polymers, metal materials and ceramic materials as a coating. Biocompatible metals and metal alloys for permanent implants include stainless steels for example (such as 316L), cobalt-based alloys (such as CoCrMo cast alloys, CoCrMo forged alloys, CoCrWNi forged alloys and CoCrNiMo forged alloys), pure titanium and titanium alloys (for example cp titanium, TiAl6V4 or TiAl6Nb7) and gold alloys. Biocorrodible stents commonly use magnesium or pure iron as well as biocorrodible master alloys of the elements magnesium, iron, zinc, molybdenum and tungsten is recommended. Coatings are used to temporarily inhibit degradation, but cause other problems and can still fail to perform to permanent implant standards. There is still an ongoing need for biodegradable bone implants with a suitable in vivo corrosion rate and with simultaneous sufficient mechanical properties.

Magnesium alloy properties are determined by the type and quantity of the alloy partners and impurity elements and also by the production conditions. Some effects of the alloy partners and impurity elements on the properties of the magnesium alloys are presented in C. KAMMER, Magnesium-Taschenbuch (Magnesium Handbook), p. 156-161, Aluminum Verlag Dusseldorf, 2000 first edition and are illustrate the complexity of determining the properties of binary or ternary magnesium alloys for use thereof as implant material.

The most frequently used alloy element for magnesium is aluminum, which leads to an increase in strength as a result of solid solution hardening and dispersion strengthening and fine grain formation, but also to microporosity. Furthermore, aluminum shifts the participation boundary of the iron in the melt to considerably low iron contents, at which the iron particles precipitate or form intermetallic particles with other elements.

Calcium has a pronounced grain refinement effect and impairs castability.

Undesired accompanying elements in magnesium alloys are iron, nickel, cobalt and copper, which, due to their electropositive nature, cause a considerable increase in the tendency for corrosion.

Manganese is found in all magnesium alloys and binds iron in the form of AlMnFe sediments, such that local element formation is reduced. On the other hand, manganese is unable to bind all iron, and therefore a residue of iron and a residue of manganese always remain in the melt.

Silicon reduces castability and viscosity and, with rising Si content, worsened corrosion behavior has to be anticipated. Iron, manganese and silicon have a very high tendency to form an intermetallic phase. This phase has a very high electrochemical potential and can therefore act as a cathode controlling the corrosion of the alloy matrix.

As a result of solid solution hardening, zinc leads to an improvement in the mechanical properties and to grain refinement, but also to microporosity with tendency for hot crack formation from a content of 1.5-2% by weight in binary Mg/Zn and ternary Mg/Al/Zn alloys.

Alloy additives formed from zirconium increase the tensile strength without lowering the extension and lead to grain refinement, but also to severe impairment of dynamic recrystallization, which manifests itself in an increase of the recrystallization temperature and therefore requires high energy expenditures. In addition, zirconium cannot be added to aluminous and silicious melts because the grain refinement effect is lost.

Rare earths, such as Lu, Er, Ho, Th, Sc and In, all demonstrate similar chemical behavior and, on the magnesium-rich side of the binary phase diagram, form eutectic systems with partial solubility, such that precipitation hardening is possible.

The addition of further alloy elements in conjunction with the impurities leads to the formation of different intermetallic phases in binary magnesium alloys (MARTIENSSSEN, WARLIMONT, Springer Handbook of Condensed Matter and Materials Data, S. 163, Springer Berlin Heidelberg New York, 2005). For example, the intermetallic phase $Mg_{17}Al_{12}$ forming at the grain boundaries is thus brittle and limits the ductility. Compared to the magnesium matrix, this intermetallic phase is more noble and can form local elements, whereby the corrosion behavior deteriorates (NISANCIOGLU, K, et al, Corrosion mechanism of AZ91 magnesium alloy, Proc. Of 47th World Magnesium Association, London: Institute of Materials, 41-45).

s Besides theses influencing factors, the properties of the magnesium alloys are, in addition, also significantly dependent on the metallurgical production conditions. Impurities when alloying together the alloy partners are inevitably introduced by the conventional casting method. The prior art (U.S. Pat. No. 5,055,254 A) therefore predefines tolerance limits for impurities in magnesium alloys, and specifies tolerance limits from 0.0015 to 0.0024% Fe, 0.0010% Ni, 0.0010 to 0.0024% Cu and no less than 0.15 to 0.5 Mn for example for a magnesium/aluminum/zinc alloy with approximately 8 to 9.5% Al and 0.45 to 0.9% Zn. Tolerance limits for impurities in magnesium and alloys thereof are specified in % by HILLIS, MERECER, MURRAY: "Compositional Requirements for Quality Performance with High Purity", Proceedings 55th Meeting of the IMA, Coronado, S.74-81 and SONG, G., ATRENS, A. "Corrosion of non-Ferrous Alloys, III. Magnesium-Alloys, S. 131-171 in SCHÜTZE M., "Corrosion and Degradation", Wiley-VCH, Weinheim 2000 as well as production conditions as follows:

| Alloy | Production | State | Fe | Fe/Mn | Ni | Cu |
|---|---|---|---|---|---|---|
| pure Mg | not specified | | 0.017 | | 0.005 | 0.01 |
| AZ 91 | pressure die casting | F | | 0.032 | 0.005 | 0.040 |
| | high-pressure die casting | | | 0.032 | 0.005 | 0.040 |
| | low-pressure die casting | | | 0.032 | 0.001 | 0.040 |
| | | T4 | | 0.035 | 0.001 | 0.010 |
| | | T6 | | 0.046 | 0.001 | 0.040 |
| | gravity die casting | F | | 0.032 | 0.001 | 0.040 |
| AM60 | pressure die casting | F | | 0.021 | 0.003 | 0.010 |
| AM50 | pressure die casting | F | | 0.015 | 0.003 | 0.010 |
| AS41 | pressure die casting | F | | 0.010 | 0.004 | 0.020 |
| AE42 | pressure die casting | F | | 0.020 | 0.020 | 0.100 |

It has been found that these tolerance specifications are not sufficient to reliably rule out the formation of corrosion-promoting intermetallic phases, which exhibit a more noble electrochemical potential compared to the magnesium matrix.

SUMMARY OF THE INVENTION

A preferred embodiment is an uncoated, biodegradable bone implant. The implant includes a body that is uncoated and lacking any protective polymer, metallic or ceramic coating. The body is shaped to fix to a bone and/or bone fragment, for example in the shape of a screw, plate, wire or pin. The body is formed from a magnesium alloy comprising 0.1 to 1.6% by weight of Zn, 0.001 to 0.5% by weight of Ca, with the rest being high-purity vacuum distilled magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight. A ratio of the content of Zn to the content of Ca is no more than 3, wherein the alloy contains an intermetallic phase $Ca_2Mg_6Zn_3$ and/or $Mg_2Ca$ in a volume fraction of close to 0 to 2% whereby the intermetallic phase has an anti-corrosion effect, and wherein the content of Zr is no more than 0.0003% by weight, and wherein the body has a strength of >275 MPa, and a ratio yield point of <0.8, wherein the difference between strength and yield point is >50 MPa.

DETAILED DESCRIPTION OF THE PREFERRED EMBODIMENTS

Bone implants of the invention are biodegradable, but provide physical properties comparable to permanent implants. The bone implants lack any protective polymer, metallic or ceramic coating, and therefore avoid problems caused by conventional coatings, such as tissue inflammation. Bone implants of the invention are formed of a magnesium alloy. The magnesium alloy includes from high-purity vacuum distilled magnesium containing impurities, which promote electrochemical potential differences and/or the formation of precipitations and/or intermetallic phases. The impurities are such that the body has a strength of >275 MPa, and a ratio yield point of <0.8, wherein the difference between strength and yield point is >50 MPa.

A preferred bone implant includes a body that is shaped to fix to a bone and/or bone fragment, for example in the shape of a screw, plate, wire or pin. The body is formed from a magnesium alloy The magnesium alloy has an extraordinarily high resistance to corrosion, which is achieved as a result of the fact that the fractions of the impurity elements and the combination thereof in the magnesium matrix are extraordinarily reduced and at the same time precipitation-hardenable and solid-solution-hardenable elements are to be added, said alloy, after thermomechanical treatment, having such electrochemical potential differences between the matrix in the precipitated phases that the precipitated phases do not accelerate corrosion of the matrix in physiological media or slow down the corrosion. The solution according to the invention is based on the awareness of ensuring resistance to corrosion and resistance to stress corrosion and vibration corrosion of the magnesium matrix of the implant over the support period, such that the implant is able to withstand ongoing multi-axial stress without fracture or cracking, and simultaneously to use the magnesium matrix as a store for the degradation initiated by the physiological fluids.

Applicant has surprisingly found that:

First, the alloy contains an intermetallic phase $Ca_2Mg_6Zn_3$ and/or $Mg_2Ca$ in a volume fraction of close to 0 to 2.0% and the phase MgZn is avoided, if the content of Zn is preferably 0.1 to 2.5% by weight, particularly preferably 0.1 to 1.6% by weight, and the content of Ca is no more than 0.5% by weight, more preferably 0.001 to 0.5% by weight, and particularly preferably at least 0.1 to 0.45% by weight.

Second, compared to the conventional alloy matrices, intermetallic phases $Mg_2Ca$ and $Ca_2Mg_6Zn_3$, in particular in each case in a volume fraction of at most 2%, are primarily formed, if the alloy matrix contains 0.1 to 0.3% by weight of Zn and also 0.2 to 0.6% by weight of Ca and/or a ratio of the content of Zn to the content of Ca no more than 20, preferably no more than 10, more preferably no more than 3 and particularly preferably no more than 1.

The alloy matrix has an increasingly positive electrode potential with respect to the intermetallic phase $Ca_2Mg_6Zn_3$ and with respect to the intermetallic phase $Mg_2Ca$, which means that the intermetallic phase $Mg_2Ca$ is less noble in relation to the intermetallic phase $Ca_2Mg_6Zn_3$ and both intermetallic phases are simultaneously less noble with respect to the alloy matrix. The two phases $Mg_2Ca$ and $Ca_2Mg_6Zn_3$ are therefore at least as noble as the matrix phase or are less noble than the matrix phase in accordance with the subject matter of the present patent application. Both intermetallic phases are brought to precipitation in the desired scope as a result of a suitable heat treatment before, during and after the forming process in a regime defined by the temperature and the holding period, whereby the degradation rate of the alloy matrix can be set. As a result of this regime, the precipitation of the intermetallic phase MgZn can also be avoided practically completely. The last-mentioned phase is therefore to be avoided in accordance with the subject matter of this patent application, since it has a more positive potential compared to the alloy matrix, that is to say is much more noble compared to the alloy matrix, that is to say it acts in a cathodic manner. This leads undesirably to the fact that the anodic reaction, that is to say the corrosive dissolution of a component of the material, takes place at the material matrix, which leads to destruction of the cohesion of the matrix and therefore to destruction of the component. This destruction therefore also progresses continuously, because particles that are more noble are continuously exposed by the corrosion of the matrix and the corrosive attack never slows, down, but is generally accelerated further as a result of the enlargement of the cathode area.

In the case of the precipitation of particles which are less noble than the matrix, that is to say have a more negative electrochemical potential than the matrix, it is not the material matrix that is corrosively dissolved, but the particles themselves. This dissolution of the particles in turn leaves behind a substantially electrochemically homogenous surface of the matrix material, which, due to this lack of electrochemical inhomogeneities, already has a much lower tendency for corrosion and, specifically also due to the use of highly pure materials, itself has yet greater resistance to corrosion.

A further surprising result is that, in spite of Zr freedom or Zr contents much lower than those specified in the prior art, a grain refinement effect can be achieved that is attributed to the intermetallic phases $Ca_2Mg_6Zn_3$ and/or $Mg_2Ca$, which block movement of the grain boundaries, delimit the grain size during recrystallization, and thereby avoid an undesirable grain growth, wherein the values for the yield points and strength are simultaneously increased.

A reduction of the Zr content is therefore also particularly desirable because the dynamic recrystallization of magnesium alloys is suppressed by Zr. This result in the fact that alloys containing Zr have to be fed more and more energy during or after a forming process than alloys free from Zr in order to achieve complete recrystallization. A higher energy feed in turn signifies higher forming temperatures and a greater risk of uncontrolled grain growth during the heat treatment. This is avoided in the case of the Mg/Zn/Ca alloys free from Zr described here.

Within the context of the above-mentioned mechanical properties, a Zr content of no more than 0.0003% by weight, preferably no more than 0.0001% by weight, is therefore advantageous for the magnesium alloy according to the invention.

The previously known tolerance limits for impurities do not take into account the fact that magnesium wrought alloys are in many cases subject to a thermomechanical treatment, in particular a relatively long annealing process, as a result of which structures close to equilibrium structures are produced. Here, the metal elements interconnect as a result of diffusion and form what are known as intermetallic phases, which have a different electrochemical potential, in particular a much greater potential, compared to the magnesium matrix, whereby these phases act as cathodes and can trigger galvanic corrosion processes.

The applicant has found that, if the following tolerance limits of individual impurities are observed, the formation of intermetallic phases of this type is reliably no longer to be expected:

Fe ≤0.0005% by weight,
Si ≤0.0005% by weight,
Mn ≤0.0005% by weight,
Co ≤0.0002% by weight, preferably 0.0001% by weight,
Ni ≤0.0002% by weight, preferably 0.0001% by weight,
Cu ≤0.0002% by weight,
Al ≤0.001% by weight,
Zr ≤0.0003% by weight, preferably 0.0001
P ≤0.0001% by weight, preferably 0.00005.

With a combination of the impurity elements, the formation of the intermetallic phases more noble than the alloy matrix then ceases if the sum of the individual impurities of Fe, Si, Mn, Co, Ni, Cu and Al is no more than 0.004% by weight, preferably no more than 0.0032% by weight, even more preferably no more than 0.002% by weight and particularly preferably no more than 0.001% by weight, the content of Al is no more than 0.001% by weight, and the content of Zr is preferably no more than 0.0003% by weight, preferably no more than 0.0001% by weight.

The active mechanisms by which the aforementioned impurities impair the resistance to corrosion of the material are different.

If small Fe particles form in the alloy as a result of an excessively high Fe content, these particles act as cathodes for corrosive attack; the same is true for Ni and Cu.

Furthermore, Fe and Ni with Zr in particular, but also Fe, Ni and Cu with Zr can also precipitate as intermetallic particles in the melt; these also act as very effective cathodes for the corrosion of the matrix.

Intermetallic particles with a very high potential difference compared to the matrix and a very high tendency for formation are the phases formed from Fe and Si and also from Fe, Mn and Si, which is why contaminations with these elements also have to be kept as low as possible.

P contents should be reduced as far as possible, since, even with minimal quantities, Mg phosphides form and very severely impair the mechanical properties of the structure.

Such low concentrations therefore ensure that the magnesium matrix no longer has any intermetallic phases having a more positive electrochemical potential compared to the matrix.

In the magnesium alloy according to the invention, the individual elements from the group of rare earths and scandium (atomic number 21, 39, 57 to 71 and 89 to 103) contribute no more than 0.001% by weight, preferably no more than 0.0003% by weight and particularly preferably no more than 0.0001% by weight, to the total amount.

These additives make it possible to increase the strength of the magnesium matrix and to increase the electrochemical potential of the matrix, whereby an effect that reduces corrosion, in particular with respect to physiological media, is set.

The precipitations preferably have a size of no more than 2.0 μm, preferably of no more than 1.0 μm, particularly preferably no more than 200 nm, distributed dispersely at the grain boundaries or inside the grain.

For applications in which the materials are subject to plastic deformation and in which high ductility and possibly also a low ratio yield point (low ratio yield point=yield point/tensile strength)—that is to say high hardening—is desirable, a size of the precipitates between 100 nm and 1 μm, preferably between 200 nm and 1 μm, is particularly preferred.

For applications in which the materials are subject to no plastic deformation or only very low plastic deformation, the size of the precipitates is preferably no more than 200 nm. This is the case for example with orthopedic implants, such as screws for osteosynthesis implants. The precipitates may particularly preferably have a size, below the aforementioned preferred range, of no more than 50 nm and still more preferably no more than 20 nm.

Here, the precipitates are dispersely distributed at the grain boundaries and inside the grain, whereby the movement of grain boundaries in the event of a thermal or thermomechanical treatment and also displacements in the event of deformation are hindered and the strength of the magnesium alloy is increased.

The magnesium alloy according to the invention achieves a strength of >275 MPa, preferably >300 MPa, a yield point of >200 MPa, preferably >225 MPa, and a ratio yield point of <0.8, preferably <0.75, wherein the difference between strength and yield point is >50 MPa, preferably >100 MPa.

These significantly improved mechanical properties of the new magnesium alloys ensure that the implants withstand the ongoing multi-axial load in the implanted state over the entire support period, in spite of initiation of the degradation of the magnesium matrix as a result of corrosion.

For minimization of the mechanical asymmetry, it is of particular importance for the magnesium alloy to have a particularly fine microstructure with a grain size of no more than 5.0 μm, preferably no more than 3.0 μm, and particularly preferably no more than 1.0 without considerable electrochemical potential differences compared to the matrix phases.

A preferred method for producing a magnesium alloy having improved mechanical and electrochemical properties. The method comprises the following steps a) producing a highly pure magnesium by vacuum distillation;
b) producing a cast billet of the alloy as a result of synthesis of the magnesium according to step a) with highly pure Zn and Ca in a composition of no more than 3.0% by weight of Zn, no more than 0.6% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight;
c) homogenizing the alloy at least once and, in so doing, bringing the alloy constituents into complete solution by annealing in one or more annealing steps at one or more successively increasing temperatures between 300° C. and 450° C., with a holding period of 0.5 h to 40 h in each case;
d) optionally ageing the homogenized alloy between 100 and 450° C. for 0.5 h to 20 h;
e) forming the homogenized alloy at least once in a simple manner in a temperature range between 150° C. and 375° C.;
f) optionally ageing the homogenized alloy between 100 and 450° C. for 0.5 h to 20 h;
g) selectively carrying out a heat treatment of the formed alloy in the temperature range between 100° C. and 325°

C. with a holding period from 1 min to 10 h, preferred from 1 min to 6 h, still more preferred from 1 min to 3 h.

A content of from 0.1 to 0.3% by weight of Zn and from 0.2 to 0.4% by weight of Ca and/or a ratio of Zn to Ca of no more than 20, preferably of no more than 10 and particularly preferably of no more than 3 ensures that a volume fraction of at most up to 2% of the intermetallic phase and of the separable phases $Ca_2Mg_6Zn_3$ and $Mg_2Ca$ are produced in the matrix lattice. The electrochemical potential of both phases differs considerably, wherein the phase $Ca_2Mg_6Zn_3$ generally has a more positive electrode potential than the phase $Mg_2Ca$. Furthermore the electrochemical potential of the $Ca_2Mg_6Zn_3$ phase is almost equal compared to the matrix phase, because in alloy systems, in which only the phase $Ca_2Mg_6Zn_3$ is precipitated in the matrix phase, no visible corrosive attack takes place. The $Ca_2Mg_6Zn_3$ and/or $Mg_2Ca$ phases can be brought to precipitation in the desired scope before, during and/or after the forming in step e)—in particular alternatively or additionally during the ageing process—in a regime preselected by the temperature and the holding period, whereby the degradation rate of the alloy matrix can be set. As a result of this regime, the precipitation of the intermetallic phase MgZn can also be avoided practically completely.

This regime is determined in particular in its minimum value T by the following formula:

$$T>(40\times(\%\ Zn)+50))(\text{in.}^\circ\ C.)$$

The aforementioned formula is used to calculate the upper limit value determined by the Zn content of the alloy, wherein the following boundary conditions apply however;

- for the upper limit value of the ageing temperature in method step d) and/or f), the following is true for T: 100° C.≤T≤450° C., preferably T: 100° C.≤T≤350° C., still more preferred 100° C.≤T≤275° C.
- in the case of the maximum temperature during the at least one forming step in method step e), the following is true for T: 150° C.≤T≤375° C.
- in the case of the above-mentioned heat treatment step in method step g), the following is true for T: 100° C.≤T≤325° C.

Specifically, for the production of alloy matrices with low Zn content, attention may have to be paid, in contrast to the specified formula, to ensure that the aforementioned minimum temperatures are observed, since, if said temperatures are not met, the necessary diffusion processes cannot take place in commercially realistic times, or, in the case of method step e), impractical low forming temperatures may be established.

The upper limit of the temperature T in method step d) and/or f) ensures that a sufficient number of small, finely distributed particles not growing too excessively as a result of coagulation is present before the forming step.

The upper limit of the temperature T in method step e) ensures that a sufficient spacing from the temperatures at which the material melts is observed. In addition, the amount of heat produced during the forming process and likewise fed to the material should also be monitored in this case.

The upper limit of the temperature T in method step g) in turn ensures that a sufficient volume fraction of particles is obtained, and, as a result of the high temperatures, that a fraction of the alloy elements that is not too high is brought into solution. Furthermore, as a result of this limitation of the temperature T, it is to be ensured that the volume fraction of the produced particles is too low to cause an effective increase in strength.

The intermetallic phases $Ca_2Mg_6Zn_3$ and $Mg_2Ca$, besides their anti-corrosion effect, also have the surprising effect of a grain refinement, produced by the forming process, which leads to a significant increase in the strength and proof stress. It is thus possible to dispense with Zr particles or particles containing Zr as an alloy element and to reduce the temperatures for recrystallization.

The vacuum distillation is preferably capable of producing a starting material for a highly pure magnesium/zinc/calcium alloy with the stipulated limit values.

The total amount of impurities and the content of the additive elements triggering the precipitation hardening and solid solution hardening and also increasing the matrix potential can be set selectively and are presented in % by weight:

a) for the individual impurities:

Fe ≤0.0005; Si ≤0.0005; Mn ≤0.0005; Co ≤0.0002, preferably ≤0.0001% by weight; Ni 0.0002, preferably ≤0.0001; Cu ≤0.0002; Al ≤0.001; Zr ≤0.0003, in particular preferably ≤0.0001; P ≤0.0001, in particular preferably ≤0.00005;

b) for the combination of individual impurities in total:

Fe, Si, Mn, Co, Ni, Cu and Al no more than 0.004%, preferably no more than 0.0032% by weight, more preferably no more than 0.002% by weight and particularly preferably 0.001, the content of Al no more than 0.001, and the content of Zr preferably no more than 0.0003, in particular preferably no more than 0.0001;

c) for the additive elements:

rare earths in a total amount of no more than 0.001 and the individual additive elements in each case no more than 0.0003, preferably 0.0001.

It is particularly advantageous that the method according to the invention has a low number of forming steps. Extrusion, co-channel angle pressing and/or also a multiple forging can thus preferably be used, which ensure that a largely homogeneously fine grain of no more than 5.0 μm, preferably no more than 3.0 μm and particularly preferably no more than 1.0 μm, is achieved.

As a result of the heat treatment, $Ca_2Mg_6Zn_3$ and/or $Mg_2Ca$ precipitates form, of which the size may be up to a few μm. As a result of suitable process conditions during the production process by means of casting and the forming processes, it is possible however to achieve intermetallic particles having a size between no more than 2.0 μm, and preferably no more than 1.0 μm particularly preferably no more than 200 nm.

The precipitates in the fine-grain structure are dispersely distributed at the grain boundaries and inside the grains, whereby the strength of the alloy reaches values that, at >275 MPa, preferably >300 MPa, are much greater than those in the prior art.

The $Ca_2Mg_6Zn_3$ and/or $Mg_2Ca$ precipitates are present within this fine-grain structure in a size of no more than 2.0 μm, preferably no more than 1.0 μm.

A size of the precipitates between 100 nm and 1.0 μm, preferably between 200 nm and 1.0 μm, are particularly preferred for applications in which the materials are subject to plastic deformation and in which high ductility and possibly also a low ratio yield point (low ratio yield point=yield point/tensile strength)—that is to say high hardening—is desired.

Preferably for applications in which the materials are subject to no plastic deformation or only very low plastic deformation, the size of the precipitates is no more than 200 nm. This is the case for example with orthopedic implants, such as screws for osteosynthesis implants. The precipitates may particularly preferably have a size, below the aforementioned preferred range, of no more than 50 nm and most preferably no more than 20 nm.

The invention also concerns the use of the magnesium alloy produced by the method and having the above-described advantageous composition and structure in medical engineering, in particular for the production of implants, for fastening and temporarily fixing orthopedic implants, dental implants and neuro implants.

EXEMPLARY EMBODIMENTS

The starting material of the following exemplary embodiments is in each case a highly pure Mg alloy, which has been produced by means of a vacuum distillation method. Examples for such a vacuum distillation method are disclosed in the Canadian patent application "process and apparatus for vacuum distillation of high-purity magnesium" having application number CA2860978 (A1), and corresponding U.S. application Ser. No. 14/370,186, which is incorporated within its full scope into the present disclosure.

Example 1

A magnesium alloy having the composition 1.5% by weight of Zn and 0.25% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, and the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to homogenization annealing at a temperature of 400° C. for a period of 1 h and then aged for 4 h at 200° C. The material is then subjected to multiple extrusion at a temperature of 250 to 300° C. in order to produce a precision tube for a cardio vascular stent.

Example 2

A further magnesium alloy having the composition 0.3% by weight of Zn and 0.35% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight, and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to homogenization annealing at a temperature of 350° C. for a period of 6 h and in a second step at a temperature of 450° C. for 12 h and is then subjected to multiple extrusion at a temperature of 275 to 350° C. in order to produce a precision tube for a cardiovascular stent.

Hardness-increasing $Mg_2Ca$ particles can be precipitated in intermediate ageing treatments; these annealing can take place at a temperature from 180 to 210° C. for 6 to 12 hours and leads to an additional particle hardening as a result of the precipitation of a further family of $Mg_2Ca$ particles.

As a result of this exemplary method, the grain size can be set to <5.0 μm or <1 μm after adjustment of the parameters.

The magnesium alloy reached a strength level of 290-310 MPa and a 0.2% proof stress of ≤250 MPa.

Example 3

A further magnesium alloy having the composition 2.0% by weight of Zn and 0.1% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 6 h, and is then subjected to multiple extrusion at a temperature from 250 to 350° C. to produce a precision tube for a cardiovascular stent. Annealing then takes place at a temperature from 250 to 300° C. for 5 to 10 min. Metallic phases $Ca_2Mg_6Zn_3$ are predominantly precipitated out as a result of this process from various heat treatments.

The grain size can be set to <3.0 μm as a result of this method.

The magnesium alloy achieved a strength level of 290-340 MPa and a 0.2% proof stress of ≤270 MPa.

Example 4

A further magnesium alloy having the composition 1.0% by weight of Zn and 0.3% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 10 h, and is then subjected to multiple extrusion at a temperature from 270 to 350° C. to produce a precision tube for a cardio vascular stent. Alternatively to these steps, ageing at approximately at 250° C. with a holding period of 2 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process, both the phase $Ca_2Mg_6Zn_3$ and also the phase $Mg_2Ca$ can be precipitated.

The grain size can be set to <2.0 μm as a result of this method.

The magnesium alloy achieved a strength level of 350-370 MPa and 0.2% proof stress of 285 MPa.

Example 5

A further magnesium alloy having the composition 0.2% by weight of Zn and 0.3% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 10 h, and is then subjected to multiple extrusion at a temperature from 225 to 375° C. to produce a precision tube for a cardio vascular stent. Alternatively to these steps, ageing at approximately at 200 to 275° C. with a holding period of 1 to 6 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process the phase $Mg_2Ca$ can be precipitated.

The grain size can be set to <2.0 μm as a result of this method.

The magnesium alloy achieved a strength level of 300-345 MPa and 0.2% proof stress of 275 MPa.

Example 6

A further magnesium alloy having the composition 0.1% by weight of Zn and 0.25% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 12 h and is then subjected to a second homogenization annealing process at a temperature of 450° C. for a period of 10 h, and is then subjected to multiple extrusion at a temperature from 300 to 375° C. to produce a precision tube for a cardio vascular stent. Alternatively to these steps, ageing at approximately at 200 to 250° C. with a holding period of 2 to 10 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process, both the phase $Ca_2Mg_6Zn_3$ and also the phase $Mg_2Ca$ can be precipitated out.

The grain size can be set to <2.0 μm as a result of this method.

The magnesium alloy achieved a strength level of 300-345 MPa and 0.2% proof stress of ≤275 MPa.

Example 7

A further magnesium alloy having the composition 0.3% by weight of Ca and the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 15 h and is then subjected to a second homogenization annealing process at a temperature of 450° C. for a period of 10 h, and is then subjected to multiple extrusion at a temperature from 250 to 350° C. to produce a precision tube for a cardio vascular stent. Alternatively to these steps, ageing at approximately at 150 to 250° C. with a holding period of 1 to 20 hours can take place after the second homogenization annealing process and before the forming process. In addition, an annealing process at a temperature of 325° C. can take place for 5 to 10 min as a completion process after the forming process.

As a result of these processes, in particular as a result of the heat regime during the extrusion process, the phase $Mg_2Ca$ can be precipitated being less noble than the matrix and thereby providing anodic corrosion protection of the matrix.

The grain size can be set to <2.0 μm as a result of this method.

The magnesium alloy achieved a strength level of >340 MPa and 0.2% proof stress of ≤275 MPa.

Example 8

A further magnesium alloy having the composition 0.2% by weight of Zn and 0.5% by weight of Ca, with the rest being formed by Mg with the following individual impurities in % by weight is produced:

Fe: <0.0005; Si: <0.0005; Mn: <0.0005; Co: <0.0002; Ni: <0.0002; Cu <0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 360° C. for a period of 20 h and is then subjected to a second homogenization annealing process at a temperature of 425° C. for a period of 6 h, and is then subjected to an extrusion process at 335° C. to produce a rod with 8 mm diameter that has been subsequently aged at 200 to 250° C. with a holding period of 2 to 10 hours for production of screws for craniofacial fixations. The grain size achieved was <2.0 μm as a result of this method. The magnesium alloy achieved a strength of >375 MPa and proof stress of <300 MPa.

The 8 mm diameter rod was also subjected to a wire drawing process to produce wires for fixation of bone fractures. Wires were subjected to an annealing at 250° C. for 15 min. The grain size achieved was <2.0 μm as a result of this method. The magnesium alloy achieved a strength level of >280 MPa and 0.2% proof stress of 190 MPa.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An uncoated, biodegradable corrosion resistant bone implant comprising a body being uncoated and lacking any protective polymer, metallic or ceramic coating, the body being shaped to fix to a bone or bone fragment;

the body being a magnesium alloy comprising 0.1 to 1.6% by weight of Zn, 0.001 to 0.5% by weight of Ca, with the rest being high-purity vacuum distilled magnesium containing impurities in a total amount of no more than 0.005% by weight of Fe, Si, Mn, Co, Ni, Cu, Al, Zr and P, wherein the content of Zr impurity is no more than 0.0003% by weight, and wherein the alloy contains elements selected from the group of rare earths with the atomic number 21, 39, 57 to 71 and 89 to 103 in a total amount of no more than 0.002% by weight;

wherein a ratio of the content of Zn to the content of Ca is no more than 3, wherein the alloy contains an intermetallic phase of one or both of $Ca_2Mg_6Zn_3$ and $Mg_2Ca$ in a volume fraction of up to 2% whereby the intermetallic phase has an anti-corrosion effect, and wherein the body has a tensile strength of >275 MPa, and a ratio yield point of <0.8.

2. The bone implant of claim 1, wherein the body is shaped as a screw, plate, wire or pin.

3. The bone implant of claim 1, wherein the alloy does not contain an intermetallic phase MgZn.

4. The bone implant of claim 1, wherein the content of Ca is 0.2 to 0.45% by weight, and the alloy contains the intermetallic phase $Mg_2Ca$.

5. The bone implant of claim 1, wherein a ratio of the content of Zn to the content of Ca is no more than 1.

6. The bone implant of claim 1, wherein individual impurities contributing to the total sum of the impurities are present in the following amounts in % by weight: Fe ≤0.0005; Si ≤0.0005; Mn ≤0.0005; Co ≤0.0002; Ni ≤0.0002; Cu ≤0.0002; Al ≤0.001; Zr ≤0.0003; P ≤0.0001.

7. The bone implant of claim 1, wherein a combination of the impurity elements Fe, Si, Mn, Co, Ni, Cu and Al totals no more than 0.004% by weight, the content of Al is no more than 0.001% by weight, and/or the content of Zr is no more than 0.0003% by weight.

8. The bone implant of claim 1, wherein individual elements from the group of rare earths total no more than 0.001% by weight.

9. The bone implant of claim 1, wherein the alloy has a fine-grain microstructure with a grain size of no more than 5.0 μm without considerable electrochemical potential differences between the individual matrix phases.

10. The bone implant of claim 1, wherein the intermetallic phase is as noble as the matrix phase or less noble than the matrix phase.

11. The bone implant of claim 1, having precipitates with a size of no more than 2.0 μm and are distributed dispersely at the grain boundaries or inside the grain.

12. The bone implant of claim 1, wherein a combination of the impurity elements Fe, Si, Mn, Co, Ni, Cu and Al totals no more than 0.001% by weight, the content of Al is no more than 0.001% by weight, and/or the content of Zr is no more than 0.0001% by weight.

13. The bone implant of claim 1, wherein individual elements from the group of rare earths total no more than 0.0003% by weight.

14. The bone implant of claim 1, wherein individual elements from the group of rare earths total no more than 0.0001% by weight.

15. The bone implant of claim 1, wherein the alloy has a fine-grain microstructure with a grain size of no more than 3.0 μm without considerable electrochemical potential differences between the individual matrix phases.

16. The bone implant of claim 1, wherein the alloy has a fine-grain microstructure with a grain size of no more than 1.0 μm.

17. An uncoated, biodegradable corrosion resistant bone implant comprising a body being uncoated and lacking any protective polymer, metallic or ceramic coating, the body being shaped to fix to a bone or bone fragment;

the body being a magnesium alloy comprising 0.1 to 1.6% by weight of Zn, 0.001 to 0.5% by weight of Ca, with the rest being high-purity vacuum distilled magnesium containing impurities in a total amount of no more than 0.005% by weight of Fe, Si, Mn, Co, Ni, Cu, Al, Zr and P, wherein the content of Zr impurity is no more than 0.0003% by weight, and wherein the alloy contains elements selected from the group of rare earths with the atomic number 21, 39, 57 to 71 and 89 to 103 in a total amount of no more than 0.002% by weight;

wherein a ration of the content of Zn to the content of Ca is no more than 3, wherein the alloy contains an intermetallic phase of one or both of $Ca_2Mg_6Zn_3$ and $Mg_2Ca$ in a volume fraction of up to 2% whereby the metallic phase has an anti-corrosion effect, and wherein the body has a tensile strength of >300 MPa, a yield point of >225 MPa, and a ratio yield point of <0.75, wherein the difference between tensile strength and yield point is >100 MPa.

* * * * *